US006059530A

United States Patent [19]

Lee

[11] Patent Number: 6,059,530

[45] Date of Patent: May 9, 2000

[54] TWIN RIB TURBINE BLADE

[75] Inventor: Ching-Pang Lee, Cincinnati, Ohio

[73] Assignee: General Electric Company, Cincinnati, Ohio

[21] Appl. No.: 09/217,662

[22] Filed: Dec. 21, 1998

[51] Int. Cl.[7] ..... F01D 5/18

[52] U.S. Cl. ..... 416/97 R; 416/96 A

[58] Field of Search ..... 416/96 A, 97 A, 416/97 R, 90, 92; 415/115, 173.1, 173.5

[56] References Cited

U.S. PATENT DOCUMENTS 3,635,585 1/1972 Metzler, Jr. ..... 416/96
3,854,842 12/1974 Caudill ..... 415/116
4,424,001 1/1984 North et al. ..... 416/92
5,261,789 11/1993 Butts et al. ..... 416/96 R
5,503,527 4/1996 Lee et al. ..... 416/91

*Primary Examiner*—Edward K. Look
*Assistant Examiner*—Rhonda Barton
*Attorney, Agent, or Firm*—Andrew C. Hess; Rodney M. Young

[57] ABSTRACT

A turbine blade includes an airfoil and integral dovetail. The airfoil includes first and second sidewalls joined together at leading and trailing edges, and extending from a root to a tip plate. Twin ribs extend outwardly from the tip plate between the leading and trailing edges, and are spaced laterally apart to define an open-top tip channel therebetween. Each of the tip ribs has an airfoil profile for extracting energy from combustion gases flowable around the turbine blade.

20 Claims, 3 Drawing Sheets

TWIN RIB TURBINE BLADE

BACKGROUND OF THE INVENTION

The present invention relates generally to gas turbine engines, and, more specifically, to turbine blade cooling.

In a gas turbine engine, air is pressurized in a compressor and mixed with fuel in a combustor to generate hot combustion gases which flow downstream through one or more turbines which extract energy therefrom. A turbine includes a row of circumferentially spaced apart rotor blades extending radially outwardly from a supporting rotor disk. Each blade typically includes a dovetail which permits assembly and disassembly of the blade in a corresponding dovetail slot in the rotor disk. An airfoil extends radially outwardly from the dovetail.

The airfoil has a generally concave pressure side and generally convex suction side extending axially between corresponding leading and trailing edges and radially between a root and a tip. The blade tip is spaced closely to a radially outer turbine shroud for minimizing leakage therebetween of the combustion gases flowing downstream between the turbine blades. Maximum efficiency of the engine is obtained by minimizing the tip clearance or gap, but is limited by the differential thermal expansion and contraction between the rotor blades and the turbine shroud for reducing the likelihood of undesirable tip rubs.

Since the turbine blades are bathed in hot combustion gases, they require effective cooling for ensuring a useful life thereof. The blade airfoils are hollow and disposed in flow communication with the compressor for receiving a portion of pressurized air bled therefrom for use in cooling the airfoils. Airfoil cooling is quite sophisticated and may be effected using various forms of internal cooling channels and features, and cooperating cooling holes through the walls of the airfoil for discharging the cooling air.

The airfoil tip is particularly difficult to cool since it is located directly adjacent to the turbine shroud, and the hot combustion gases flow through the tip gap therebetween. A portion of the air channeled inside the airfoil is typically discharged through the tip for cooling thereof. The tip typically includes a continuous radially outwardly projecting edge rib disposed coextensively along the pressure and suction sides between the leading and trailing edges. The tip rib follows the aerodynamic contour around the airfoil and is a significant contributor to the aerodynamic efficiency thereof.

The tip rib has portions spaced apart on the opposite pressure and suction sides to define an open top tip cavity. A tip plate or floor extends between the pressure and suction side ribs and encloses the top of the airfoil for containing the cooling air therein. And, tip holes extend through the floor for cooling the tip and filling the tip cavity.

The pressure and suction side ribs are preferably equal in height to define a two-tooth labyrinth seal with the turbine shroud. The cooling air discharged into the tip cavity pressurizes that cavity and assists in maintaining an effective tip seal.

The tip rib is typically the same thickness as the underlying airfoil sidewalls and provides sacrificial material for withstanding occasional tip rubs with the shroud without damaging the remainder of the tip or plugging the tip holes for ensuring continuity of tip cooling over the life of the blade.

The tip ribs, also referred to as squealer tips, are typically solid and provide a relatively large surface area which is heated by the hot combustion gases. Since they extend above the tip floor they experience limited cooling from the air being channeled inside the airfoil. Typically, the tip rib has a large surface area subject to heating from the combustion gases, and a relatively small area for cooling thereof. The blade tip therefore operates at a relatively high temperature and thermal stress, and is typically the life limiting point of the entire airfoil.

Accordingly, it is desired to provide a gas turbine engine turbine blade having improved tip cooling.

BRIEF SUMMARY OF THE INVENTION

A turbine blade includes an airfoil and integral dovetail. The airfoil includes first and second sidewalls joined together at leading and trailing edges, and extending from a root to a tip plate. Twin tip ribs extend outwardly from the tip plate between the leading and trailing edges, and are spaced laterally apart to define an open-top tip channel therebetween. Each of the tip ribs has an airfoil profile for extracting energy from combustion gases flowable around the turbine blade.

DETAILED DESCRIPTION OF THE INVENTION

Figure 1:
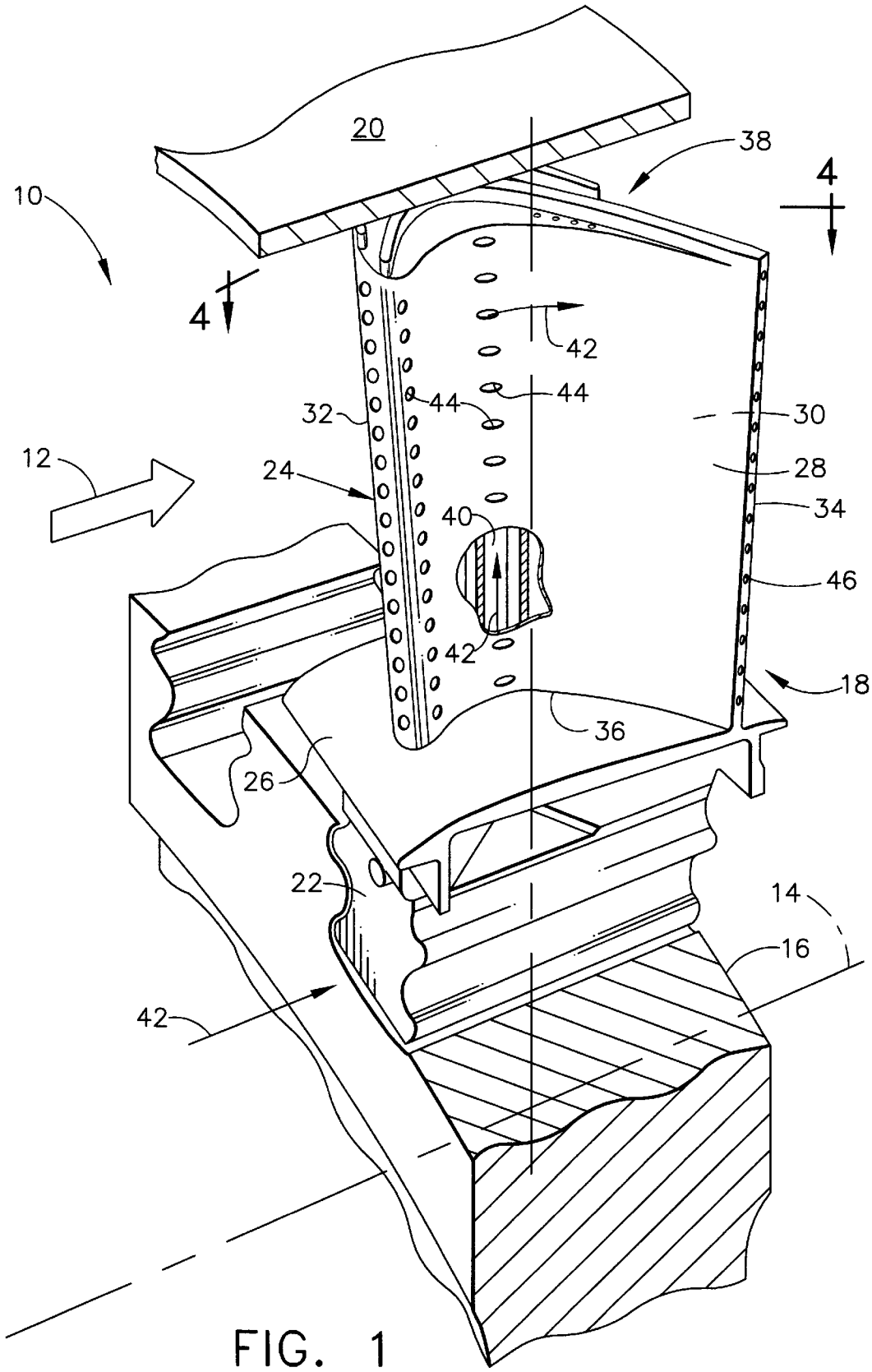
FIG. 1 is a partly sectional, isometric view of an exemplary gas turbine engine turbine rotor blade mounted in a rotor disk within a surrounding shroud, with the blade having a tip in accordance with an exemplary embodiment of the present invention.

Illustrated in FIG. 1 is a portion of a high pressure turbine 10 of a gas turbine engine which is mounted directly downstream from a combustor (not shown) for receiving hot combustion gases 12 therefrom. The turbine is axisymmetrical about an axial centerline axis 14 and includes a rotor disk 16 from which extend radially outwardly a plurality of circumferentially spaced apart turbine rotor blades 18, one being shown. An annular turbine shroud 20 is suitably joined to a stationary stator casing and surrounds the blades for providing a relatively small clearance or gap therebetween for limiting leakage of the combustion gases therethrough during operation.

Each blade 18 includes a dovetail 22 which may have any conventional form such as an axial dovetail configured for being mounted in a corresponding dovetail slot in the perimeter of the rotor disk 16. A hollow airfoil 24 is integrally joined to the dovetail and extends radially or longitudinally outwardly therefrom. The blade also includes an integral platform 26 disposed at the junction of the airfoil and dovetail for defining a portion of the radially inner flowpath for the combustion gases 12. The blade may be formed in any conventional manner, and is typically a one-piece casting.

The airfoil 24 includes a generally concave, first or pressure sidewall 28 and a circumferentially or laterally opposite, generally convex, second or suction sidewall 30 extending axially or chordally between opposite leading and trailing edges 32,34. The two sidewalls also extend in the radial or longitudinal direction between a radially inner root 36 at the platform 26 and a radially outer tip 38.

The airfoil first and second sidewalls are spaced apart in the lateral or circumferential direction over the entire longitudinal or radial span of the airfoil to define at least one internal flow chamber or channel 40 for channeling cooling air 42 through the airfoil for cooling thereof. The cooling air is typically bled from the compressor (not shown) in any conventional manner.

The inside of the airfoil may have any conventional configuration including, for example, serpentine flow channels with various turbulators therein for enhancing cooling air effectiveness, with the cooling air being discharged through various holes through the airfoil such as conventional film cooling holes 44 and trailing edge discharge holes 46.

As indicated above, a conventional turbine blade tip includes a continuous rib disposed coextensively with the pressure and suction sidewalls between the leading and trailing edges which maintains the aerodynamic profile of the airfoil while providing an effective tip seal with the turbine shroud against which it may occasionally rub during operation. Such ribs are difficult to cool since they are exposed to the hot combustion gases which flow thereover during operation.

Figure 2:
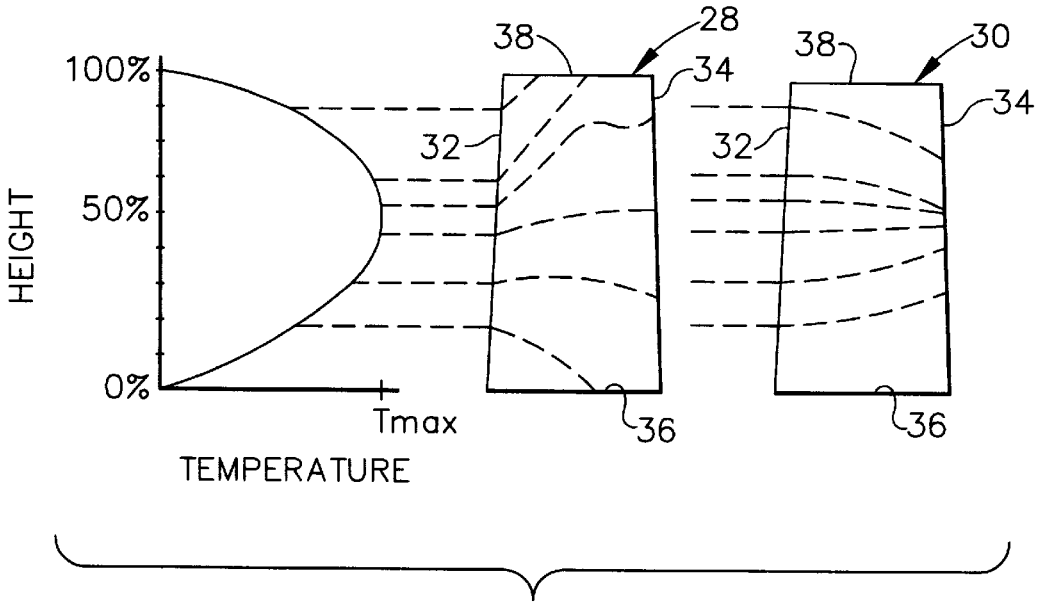
FIG. 2 is a schematic representation of an exemplary relative inlet temperature profile over pressure and suction sides of the blade illustrated in FIG. 1.

FIG. 2 illustrates an exemplary relative inlet temperature profile of the combustion gases 12 as experienced by each of the rotating blades 18. The temperature profile is generally center peaked or generally parabolic as shown at the left of FIG. 2, with a maximum temperature $T_{max}$ typically located in the range of airfoil span or radial height between about 50–70%. Zero percent is at the blade root 36, and 100% is at the radially outermost portion or tip 38 of the airfoil.

The corresponding gas temperature pattern experienced by the pressure side of the first sidewall 28 during operation is illustrated in the middle of FIG. 2. And, the gas temperature pattern experienced by the suction side of the airfoil second sidewall 30 is illustrated in the right of FIG. 2.

Although the gas temperature pattern experienced by the airfoil 24 is typically center-peaked at the blade leading edges 32, secondary flow fields between circumferentially adjacent airfoils distort the temperature profile substantially in the blade tip region on the pressure or first sidewall 28. The gas temperature at the pressure side tip region is substantially greater than the temperature at the suction side tip region, and increases with a substantial gradient primarily from the leading edge 32 to the mid-chord region upstream of the trailing edge 34 at the blade tip.

However, and in accordance with the present invention, the distorted gas temperature pattern illustrated in FIG. 2 may be used to advantage for reducing the gas temperature otherwise experienced by the blade tip on the pressure, first sidewall 28 for reducing the operating temperature of the blade tip or decreasing the need for internal cooling, for in turn increasing overall efficiency of operation.

Figure 3:
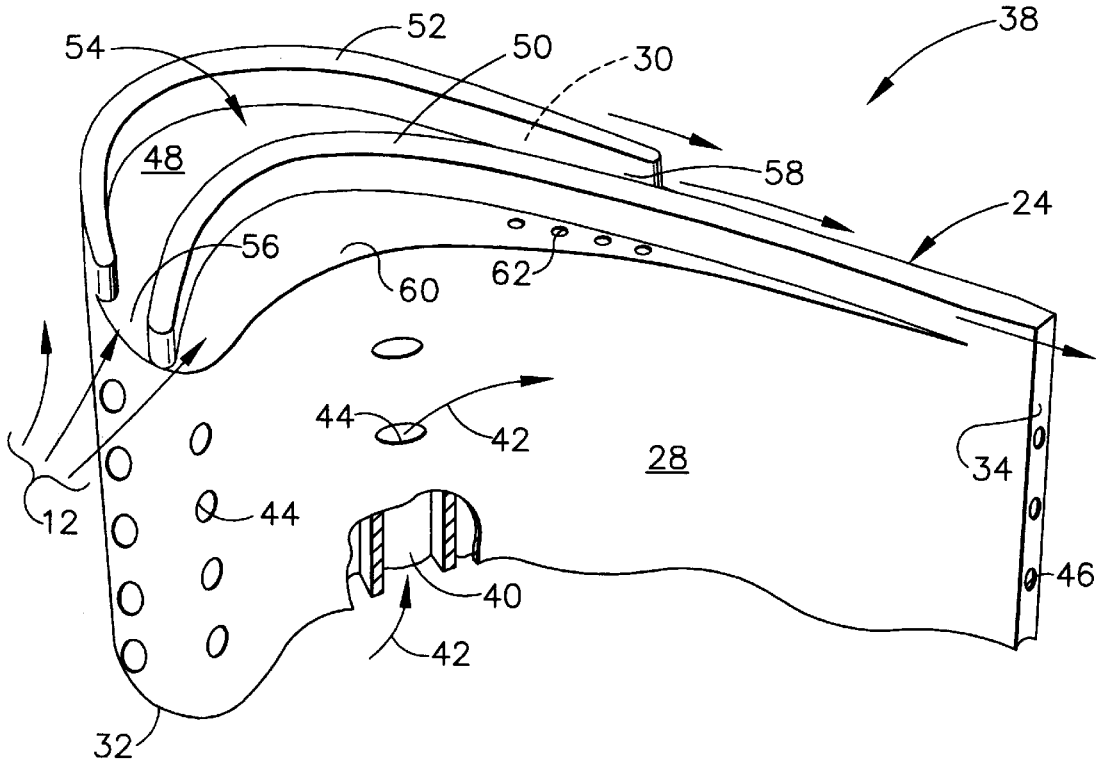
FIG. 3 is an isometric view of the blade tip illustrated in FIG. 1 having a pair of aerodynamic tip ribs in accordance with an exemplary embodiment.
Figure 4:
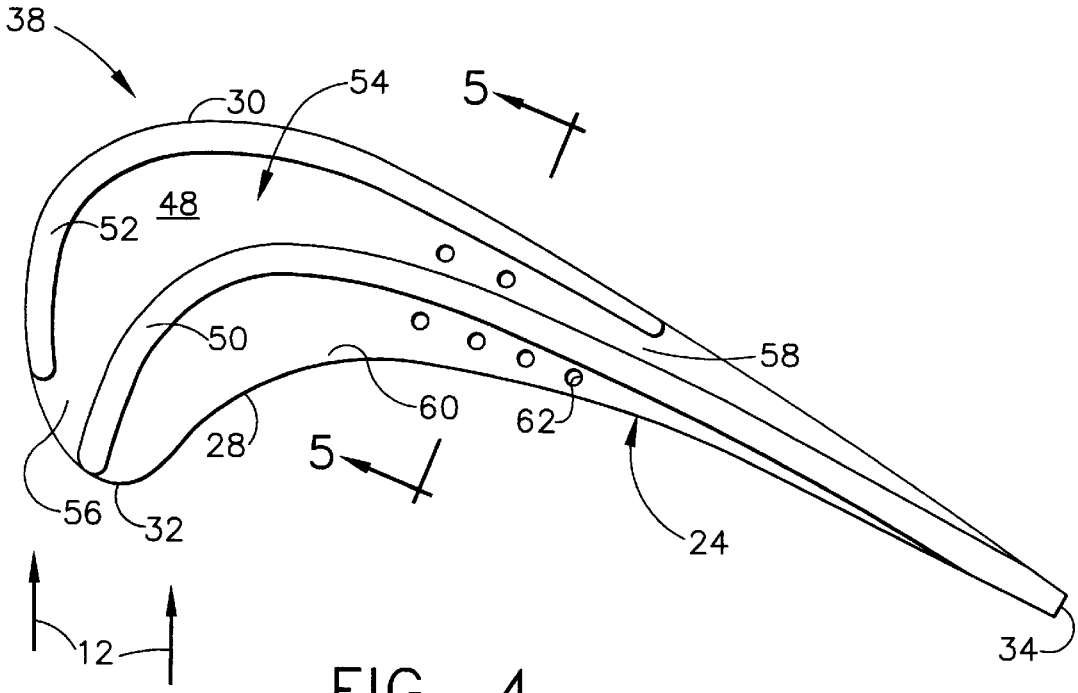
FIG. 4 is a top view of the blade tip illustrated in FIG. 1 and taken along line 4—4.

The blade tip is illustrated in more detail in FIGS. 3 and 4. The tip includes a tip floor or plate 48 disposed integrally atop the radially outer ends of the first and second sidewalls 28,30 which bounds the internal cooling channel 40.

A first tip wall or rib 50 extends radially outwardly from the tip plate 48 between the leading and trailing edges. A second tip wall or rib 52 extends radially outwardly from the tip plate 48 between the leading and trailing edges, and is spaced laterally from the first tip rib 50 to define an open-top tip channel 54 therebetween. The tip channel 54 includes a tip inlet 56 defined laterally between the forward ends of the two ribs 50,52 near the leading edge for receiving a portion of the combustion gases therein.

The tip channel also includes an axially opposite tip outlet 58 defined laterally between the aft end of the second tip rib 52 and the directly adjacent portion of the first tip rib 50 near or upstream of the airfoil trailing edge 34 for discharging the combustion gases from the tip channel 54. Since the tip channel is also open along its entire radially outer portion, the combustion gases may also be discharged therefrom.

The inlet 56 and the outlet 58 for the tip channel 54 preferably extend the full height of the two tip ribs and permit the combustion gases to flow through the tip channel without obstruction. The static pressure distribution of the combustion gases around the airfoil varies from a maximum value near the airfoil leading edge 32 to correspondingly reduced values at the trailing edge 34, with the pressure being lower along the airfoil second sidewall 30 than along the airfoil first sidewall 28 as is conventionally known. The varying pressure profile is effected by the aerodynamic contour of the airfoil for producing a differential pressure across the pressure and suction sides and a corresponding lift force for in turn rotating the rotor disk to which the blades are attached. In this way, energy is extracted from the combustion gases by the aerodynamic profile of the turbine blades for producing useful work.

The configuration of the two tip ribs 50,52 is selected in accordance with the present invention to take advantage of the varying pressure profile of the combustion gases around the airfoil for driving the combustion gases through the tip inlet 56 and through the tip channel 54 in an axially aft direction for discharge from the aft tip outlet 58.

In the preferred embodiment, each of the first and second tip ribs 50,52 has an airfoil profile including laterally opposite generally concave and generally convex sides extending from the tip inlet 56 to the tip outlet 58 for extracting energy from the combustion gases during operation. In addition to the main airfoil 24 itself, which extracts energy from the combustion gases, the two tip ribs are independently configured to define twin aerodynamic ribs which individually extract energy from the combustion gases in the manner of an airfoil to collectively contribute to the energy extracted by the airfoil for increasing the overall aerodynamic efficiency of the airfoil by individually providing aerodynamic lift force.

The first and second tip ribs preferably conform in aerodynamic profile with each other for similarly extracting energy from the combustion gases. The twin ribs laterally face each other at the tip inlet 56 for providing an aerodynamically efficient inlet for the tip channel for flow of the combustion gases over the corresponding tip ribs 50,52 without undesirable flow separation. The respective leading edge portions of the twin ribs 50,52 are initially generally parallel to each other and angled toward the airfoil leading edge generally parallel to the incident angle of the combustion gases 12 directed toward the airfoil leading edge.

FIG. 2 illustrates that the temperature of the combustion gases 12 at the blade tip near the leading edge is substantially less than the gas temperature downstream of the leading edge, by several hundred degrees for example. Accordingly, the relatively cooler, yet hot, combustion gas 12 available at the airfoil leading edge is channeled through the tip inlet 56 into the tip channel 54 which is bound on its opposite lateral sides by the first and second tip ribs 50,52. This cooler combustion gas may therefore be effectively used for cooling the blade tip downstream from the leading edge where it is exposed to hotter combustion gases.

In this way, although the outboard side of the first tip rib 50 is subject to the increasing temperature gradient of the combustion gases downstream from the leading edge, the inboard side of the first tip rib 50 is bathed in the substantially cooler combustion gases extracted at the airfoil leading edge. Accordingly, the first tip rib 50 experiences a reduction in heat influx thereto. The temperature of the first rib 50 may be reduced for a given amount of cooling air, or a reduction in the cooling air requirements may be effected for a given temperature of operation.

As shown in FIGS. 3 and 4, each of the tip ribs 50,52 may have a separately defined aerodynamic profile for maximizing the aerodynamic lift therefrom without undesirable flow separation. Each of the two ribs has a generally concave pressure side and a generally convex suction side extending from respective forward or leading edges thereof to aft or trailing edges thereof.

The twin ribs 50,52 are preferably laterally nested, with the convex side of the first rib 50 being aligned with the concave side of the second rib 52 immediately aft of the leading edge 32 in the maximum thickness portion of the airfoil. In this way, the aerodynamic profile of the twin ribs 50,52 corresponds with the underlying aerodynamic profile of the airfoil 24 so that the resulting aerodynamic lift components therefrom are oriented in substantially the same direction for efficiently extracting energy from the combustion gases.

Figure 5:
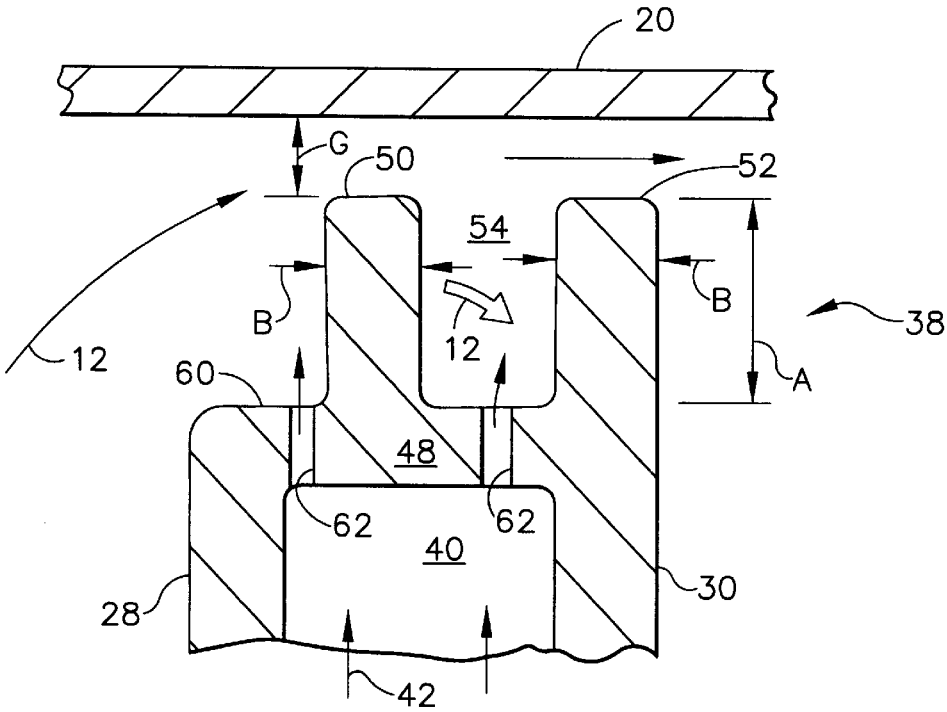
FIG. 5 is an elevational, sectional view through the blade tip illustrated in FIG. 4, within the turbine shroud, and taken generally along line 5—5.

As shown in FIG. 5, the twin ribs 50,52 preferably have equal and constant heights A as measured radially outwardly from the tip plate 48. The ribs also preferably have constant height along their full axial extent from the airfoil leading edge 32 to the trailing edge 34. In this way, the twin ribs 50,52 may be spaced radially inwardly from the turbine shroud 20 for defining a tip clearance or gap G therebetween. The twin ribs therefore effect a two-tooth labyrinth seal with the turbine shroud which is pressurized by the combustion gases 12 flowing through the tip channel 54 during operation. Since the combustion gases have a maximum pressure at the airfoil leading edge which decreases downstream therefrom, the extracted high pressure combustion gases flowing through the tip channel 54 during operation pressurize the tip channel 54 relative to the lower gas pressure outside thereof.

In the preferred embodiment illustrated in FIGS. 3 and 4, the first tip rib 50 extends continuously from the airfoil leading edge 32 to the airfoil trailing edge 34 of which it forms the radially outermost portion. In this way, the first tip rib 50 corresponds axially with the full axial extent of the airfoil pressure side 28 for providing an effective barrier or boundary for the combustion gases under the relatively high pressure and temperature distribution thereof.

Correspondingly, the second tip rib 52 preferably extends short of the airfoil leading and trailing edges 32,34, and has opposite axial ends spaced therefrom. Since the leading edge region of the airfoil is relatively wide, both ribs 50,52 may be disposed closely adjacent to the leading edge and oriented for efficiently receiving the incident combustion gases thereat. Since the trailing edge region of the airfoil is relatively thin, the aft end of the second rib 52 terminates forward of the airfoil trailing edge 34 in a region of sufficient lateral space for at least both tip ribs 50,52 and the outlet 58 therebetween. In an alternate embodiment, more than two ribs may be used if space permits.

As shown in FIG. 5, each of the tip ribs has a lateral width or thickness B which are preferably equal to each other, as well as being preferably equal to the thicknesses of the underlying airfoil first and second sidewalls 28,30 which may be formed in a typical one-piece casting.

The first tip rib 50 is preferably laterally offset from the first sidewall 38 at least in part from the airfoil leading edge 32 toward the trailing edge 34 as shown in FIGS. 3–5. As shown in FIG. 4, the forward end of the first rib 50 is generally normal to the forward surface of the airfoil leading edge whereas the aft end of the first rib blends generally parallel into the trailing edge. The first rib is laterally offset from the first sidewall 28 between its forward and aft ends to expose a tip shelf 60 portion of the tip plate 48.

In the preferred embodiment, the first sidewall 28 defines a generally concave, pressure sidewall of the airfoil, and the second sidewall 30 defines a generally convex, suction sidewall of the airfoil. The exposed tip shelf 60 is therefore preferably disposed along the airfoil pressure sidewall 28 which is subjected to maximum temperature of the combustion gases.

As shown in FIG. 5, the first tip rib 50 is disposed in most part directly atop the cooling channel 40, and the tip plate 48 includes a plurality of tip holes 62 extending radially therethrough in flow communication between the cooling channel 40 and both the tip shelf 60 and the tip channel 54. In this way, heat transfer is increased from the first rib 50 through the underlying tip shelf 48 into the cooling channel 40 for improving the conduction cooling of the first tip rib 50.

A portion of the cooling air 42 is discharged through the film holes 62 through the tip shelf for film cooling the pressure side of the first tip rib 50 preferably at least in the midchord location subject to the maximum temperature distribution illustrated in FIG. 2. A portion of the cooling air 42 is also discharged through the tip holes 62 into the tip channel 54 for mixing with the combustion gases 12 therein and further decreasing the temperature therein for cooling both tip ribs from their inboard sides.

Furthermore, since the first tip rib is laterally offset from the airfoil first sidewall 28, it is necessarily closer to the second tip rib 52 for reducing the width of the tip channel 54. The reduced width tip channel 54 is more effectively pressurized by the combustion gases channeled therethrough either alone or in combination with the cooling air discharged from the tip holes. This enhanced pressurization of the tip channel 54 reduces the likelihood of recirculation of the combustion gases which flow through the tip gap G during operation for further reducing cooling requirements of the blade tip. And, the increased pressurization improves the labyrinth sealing capability of the twin ribs 50,52 in cooperation with the stationary turbine shroud 20.

Although the second tip rib 52 could be laterally offset from the airfoil second, suction sidewall 30 either instead of or in addition to the lateral offset of the first tip rib 50, the second tip rib 52 is preferably coextensive with the airfoil second sidewall. Since the temperature experienced by the second tip rib 52 is less than that experienced by the first tip rib 50, the increased cooling thereof due to lateral offset is not required in this exemplary embodiment.

The twin rib turbine blade disclosed above therefore utilizes a novel configuration of laterally nested squealer tip ribs for reducing blade tip temperature during operation, while maintaining effective labyrinth sealing with the turbine shroud, and also with enhanced aerodynamic efficiency.

The twin ribs utilize a portion of the lower temperature combustion gases for protecting the blade tip against the hotter temperature combustion gases, while pressurizing the tip channel between the ribs for effecting labyrinth sealing. The need for cooling air at the blade tip is reduced and may be locally used near the mid-chord region subject to maximum combustion gas temperature due to the secondary flow circulation.

While there have been described herein what are considered to be preferred and exemplary embodiments of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured by Letters Patent of the United States is the invention as defined and differentiated in the following claims in which I claim:

1. A turbine blade comprising an airfoil and integral dovetail for mounting said airfoil to a rotor disk inboard of a turbine shroud, said airfoil including:

first and second sidewalls joined together at a leading edge and a trailing edge, and extending from a root disposed adjacent said dovetail to a tip plate for channeling thereover combustion gases, and a cooling channel disposed in said airfoil for receiving cooling fluid through said dovetail;

a first tip rib extending outwardly from said tip plate between said leading and trailing edges;

a second tip rib extending outwardly from said tip plate between said leading and trailing edges, and spaced laterally from said first tip rib to define an open-top tip channel having a tip inlet near said leading edge for receiving said combustion gases, and a tip outlet near said trailing edge for discharging said combustion gases; and each of said first and second tip ribs has an airfoil profile including opposite concave and convex sides extending from said tip inlet to said tip outlet for extracting energy from said combustion gases.

2. A blade according to claim 1 wherein said first and second tip ribs conform with each other for similarly extracting energy from said combustion gases.

3. A blade according to claim 2 wherein said first and second tip ribs laterally face each other at said tip inlet.

4. A blade according to claim 3 wherein said first and second tip ribs are laterally nested, with said convex side of said first tip rib being aligned with said concave side of said second tip rib.

5. A blade according to claim 4 wherein said first and second tip ribs have equal heights from said tip plate between said leading and trailing edges.

6. A blade according to claim 5 wherein:

said first tip rib extends from said leading edge to said trailing edge; and said second tip rib extends short of said leading and trailing edges.

7. A blade according to claim 5 wherein said first tip rib is laterally offset from said first sidewall at least in part from said leading edge toward said trailing edge to expose a shelf portion of said tip plate.

8. A blade according to claim 7 wherein said second tip rib is coextensive with said second sidewall.

9. A blade according to claim 8 wherein said first tip rib is disposed in part atop said cooling channel, and said tip plate includes a plurality of tip holes extending therethrough in flow communication between said cooling channel and both said tip shelf and tip channel for channeling said cooling fluid thereto.

10. A blade according to claim 8 wherein said first sidewall is a generally concave, pressure sidewall of said airfoil, and said second sidewall is a generally convex, suction sidewall of said airfoil.

11. A turbine airfoil comprising first and second sidewalls joined together at a tip plate extending between leading and trailing edges, and a pair of laterally spaced apart tip ribs extending outwardly from said tip plate, with each tip rib having laterally opposite concave and convex sides initiating at forward ends thereof and terminating at opposite aft ends thereof.

12. An airfoil according to claim 11 wherein said forward ends of both said tip ribs face chordally toward said leading edge.

13. An airfoil according to claim 12 wherein said rib forward ends define an inlet facing said leading edge for receiving combustion gases.

14. An airfoil according to claim 12 wherein a first one of said ribs is chordally longer than a second one of said ribs, and defines an outlet at an aft end thereof.

15. An airfoil according to claim 14 wherein said first rib extends between said leading and trailing edges on only said first sidewall, and said second rib extends short of said leading and trailing edges on only said second sidewall.

16. An airfoil according to claim 15 wherein said first and second ribs have substantially equal lateral thickness.

17. A turbine airfoil comprising twin tip ribs extending chordally between opposite forward and aft ends thereof with aerodynamically conforming lifting profiles.

18. An airfoil according to claim 17 further comprising a leading edge, and said rib forward ends face forwardly toward said leading edge.

19. An airfoil according to claim 18 wherein said ribs include corresponding convex and concave sides facing each other.

20. An airfoil according to claim 19 further comprising opposite pressure and suction sidewalls, and one of said ribs is coextensive with said suction sidewall, and another one of said ribs is offset from said pressure sidewall between said forward and aft ends thereof.

* * * * *